US006995727B2

(12) United States Patent
Tuau et al.

(10) Patent No.: US 6,995,727 B2
(45) Date of Patent: Feb. 7, 2006

(54) REFLECTOR ANTENNA FEED

(75) Inventors: Denis Tuau, Trignac (FR); Michael Greiff, Hannover (DE); Armel Le Bayon, La Baule (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 10/867,751

(22) Filed: Jun. 16, 2004

(65) Prior Publication Data

US 2005/0007288 A1 Jan. 13, 2005

(30) Foreign Application Priority Data

Jun. 17, 2003 (FR) ..... 03 50224

(51) Int. Cl.
*H01Q 19/19* (2006.01)

(52) U.S. Cl. ..... 343/781 CA; 343/785; 343/840

(58) Field of Classification Search ..... 343/781 CA, 343/785, 786, 840
See application file for complete search history.

(56) References Cited

U.S. PATENT DOCUMENTS

| | | | | |
|---|---|---|---|---|
| 4,673,945 | A * | 6/1987 | Syrigos | 343/755 |
| 4,673,947 | A * | 6/1987 | Newham | 343/781 CA |
| 4,963,878 | A | 10/1990 | Kildal | |
| 6,020,859 | A * | 2/2000 | Kildal | 343/781 CA |
| 6,724,349 | B1 * | 4/2004 | Baird et al. | 343/781 CA |
| 6,919,855 | B2 * | 7/2005 | Hills | 343/781 CA |

FOREIGN PATENT DOCUMENTS

| | | |
|---|---|---|
| EP | 1 221 740 A1 | 7/2002 |
| GB | 2 161 324 A1 | 1/1986 |

* cited by examiner

*Primary Examiner*—Tan Ho
(74) *Attorney, Agent, or Firm*—Sughrue Mion, PLLC

(57) ABSTRACT

An antenna feed comprises, aligned and centered on an axis OO', a waveguide having an inside diameter, a first end and a second end, a dielectric body having a portion inside the waveguide and a portion outside the waveguide, the outside portion comprising a section of frustoconical shape having an outside lateral surface of frustoconical shape with two ends, namely a large diameter end and a small diameter end, and a subreflector at the large diameter end of the frustoconical shape. The outside portion comprises, in addition to the frustoconical portion, a cylindrical portion whose diameter is greater than the inside diameter of the waveguide. The cylindrical portion is connected to the frustoconical portion at its small diameter end and the frustoconical outside lateral surface of the dielectric body is smooth.

7 Claims, 4 Drawing Sheets

REFLECTOR ANTENNA FEED

CROSS-REFERENCE TO RELATED APPLICATIONS

This application is based on French Patent Application No. 03 50 224 filed Jun. 17, 2003, the disclosure of which is hereby incorporated by reference thereto in its entirety, and the priority of which is hereby claimed under 35 U.S.C. § 119.

BACKGROUND OF THE INVENTION

1. Field of the Invention

The field of the invention is that of reflector antenna feed devices. The invention also relates to an antenna equipped with this kind of feed.

2. Description of the Prior Art

Patent application EP 1 221 740 describes an antenna 1 having a main reflector 10 and a feed 12, with reference to FIG. 1 of that application, which is reproduced as FIG. 1 of the present application. The antenna 1 features symmetry of revolution about an axis OO' of the antenna. FIG. 1 represents a diagrammatic half-section in a plane containing the axis OO' of symmetry. The antenna 1 comprises a main reflector 10 having a concave side in the shape of a paraboloid rotated about the axis OO', for example, so that it is markedly directional in the direction of the axis OO'. An antenna feed device 12 is situated along the axis OO' of the antenna 1, in the portion of the reflector comprising the concavity. Like the whole of the antenna, it has symmetry of revolution about the axis OO'. The feed device 12 is shown in more detail in FIG. 2. It comprises a waveguide portion 20 extending along the axis OO', in the direction from the center of the reflector 10, and within the concavity. With regard to the feed 12, it is considered that a first end 21 of the waveguide 20 consists of the location at which the waveguide 20 passes through the main reflector 10. This first end is situated at the center of the main reflector 10. A second end 22 of the waveguide 20 faces a subreflector 24. The subreflector 24 intersects the axis OO'. It has a shape obtained by rotation about the axis OO'. It has a convexity that faces toward the concavity of the main reflector 10. The outside diameter of the subreflector 24 is greater than the diameter of the waveguide 20. The exact shape of this subreflector 24 is defined by its function. In a receiving mode, the subreflector 24 reflects the electromagnetic waves coming from the main reflector 10 toward the waveguide 20. In a sending mode, the subreflector 24 reflects the electromagnetic waves coming from the waveguide 20 toward the reflector 10. In order to confine the electromagnetic waves between the second end 22 of the waveguide 20 and the subreflector 24, a portion of the feed 12 consists of a dielectric body 23 joining the second end 22 of the waveguide 20 and the subreflector 24. The confinement of the electromagnetic waves between the second end 22 of the waveguide 20 and the subreflector 24 improves the electromagnetic coupling between the subreflector 24 and the main reflector 10.

The dielectric body 23 has a portion 31 outside the waveguide 20 and a portion 30 inside the waveguide. Because of the difference between the diameter of the subreflector 24 and the diameter of the waveguide 20, an exterior surface 29 of the dielectric body 23 has a frustoconical shape with two ends, one of small diameter and the other of large diameter. The small diameter end is connected to the second end 22 of the waveguide 20. The small diameter is substantially equal to the diameter of the waveguide 20. The large diameter is substantially equal to the outside diameter of the subreflector 24.

To improve the coupling between the dielectric body 23 and the air around the frustoconical surface 29 of the dielectric body 23, the latter is provided with grooves or creases having symmetry of revolution about the axis OO'. Because of this, the frustoconical surface 29 has bosses 25 and hollows 28. These creases prevent the electromagnetic waves propagating along the surface of the subreflector 22, whether the electric field of these waves is normal or tangential to that surface. As a result of this the directional diagram of the antenna 1 is more directional in the direction of a main lobe of the antenna, and there is therefore lower dispersion in the secondary lobes. The subreflector 24 generally consists of a metallic deposit on a surface of the dielectric body 23. The concave volume delimited by the metallic deposit constituting the subreflector 24 is generally filled with a dielectric. The portion 30 of the dielectric body inside the waveguide has at the end 22 a portion 27 whose diameter is equal to the inside diameter of the waveguide 20. This portion 27 is extended in the direction of the first end 21 by a second portion 26 whose diameter decreases at one step or at several successive steps. This structural feature improves the electromagnetic coupling between the waveguide 20 and the dielectric body 23. This reduces reflection losses in particular.

Although the antenna that has just been described has improved qualities compared to other antennas that do not have these features, this antenna has a bandwidth that is limited by the constraints imposed on the maximum permitted value of the reflection loss rate. Its radiation diagram has a directional gain that is limited because of a lack of phase efficiency and thus relatively high levels in the secondary lobes. Remember that the phase center is defined as the center of a spherical wavefront. In the ideal case, that center is a point, in which case the phase efficiency is equal to 1. In practice, the center is not clearly defined and is more like a small volume. In this case the phase efficiency is less than 1. The phase efficiency of a radiation diagram may be calculated from the following formula PE1;

$$\text{Phase efficiency} = \frac{\left|\int_{\theta_1}^{\theta_2} \cos_{45}(\theta)\tan\frac{\theta}{2}d\theta\right|^2}{\left[\int_{\theta_1}^{\theta_2} \left|\cos_{45}(\theta)\right|\tan\frac{\theta}{2}d\theta\right]^2} \approx \frac{\left|\sum_{n\theta} \cos_{45}(\theta)\tan\frac{\theta}{2}\right|^2}{\left[\sum_{n\theta} \left|\cos_{45}(\theta)\right|\tan\frac{\theta}{2}\right]^2} \quad \text{(PE1)}$$

In the above formula, $COS_{45}(\theta)$ is the copolar component of the electric field in the plane at 45°.

Compared to the prior art just described, the present invention aims to improve further the coupling between the waveguide 20 and the main reflector 10, in particular by reducing the reflection loss rate. As a result, with the same constraints as in the prior art as to the maximum allowed value of the reflection rate, the bandwidth of an antenna using a feed according to the invention is increased. The invention also aims to improve the phase efficiency of the antenna, which has the effect of improving the radiation diagram of the antenna so that a greater proportion of the total energy broadcast is in its main lobe. Finally, the invention aims to simplify the shape of the dielectric body and thus make it simpler to fabricate.

Finally, using the invention means that, for the same antenna efficiency, it is possible to retain a small subreflector produced by a metallic deposit on a rear face of the dielectric.

SUMMARY OF THE INVENTION

With all the above aims in view, the invention provides an antenna feed comprising, aligned and centered on an axis OO':

a waveguide having an inside diameter $d_{pipe}$, a first end, and a second end, a dielectric body having a portion inside the waveguide and a portion outside the waveguide, the outside portion comprising a section of frustoconical shape having an outside lateral surface of frustoconical shape with two ends, namely a large diameter end and a small diameter end, a subreflector at the large diameter end of the frustoconical shape, and wherein the outside portion comprises, in addition to the frustoconical portion, a cylindrical portion whose diameter is greater than the inside diameter of the waveguide, the cylindrical portion being connected to the frustoconical portion at its small diameter end, and the frustoconical outside lateral surface of the dielectric body is smooth.

In one embodiment the small diameter of the frustoconical portion is greater than the diameter of the cylindrical outside portion of the dielectric body.

In one variant of the above embodiment the junction surface of the dielectric body between the outside cylindrical portion and the small diameter end of the frustoconical portion of the dielectric body consists of a plane circular ring perpendicular to the axis OO', delimited by two concentric circles centered on the axis OO', one having a diameter equal to the diameter of the outside cylindrical portion, the diameter of the other being equal to the small diameter of the frustoconical lateral surface.

The axial length of the cylindrical outside portion of the dielectric body is preferably from $\lambda/4$ to $\lambda/2$, $\lambda$ designating the wavelength in free space of an electromagnetic wave having a median frequency of a frequency band to which the antenna is tuned.

In an embodiment in which the value of the dielectric constant $\epsilon_r$ of the material constituting the dielectric body is close to 2.5, the value of the angle $\theta$ at the apex of the frustoconical surface of the dielectric body is close to 30°.

BRIEF DESCRIPTION OF THE DRAWINGS

One embodiment of the invention is described next with reference to the appended drawings.

DETAILED DESCRIPTION OF THE PREFERRED EMBODIMENT

Identical reference numbers designate items having identical or similar functions in all of the drawings, including those relating to the prior art.

Figure 1:
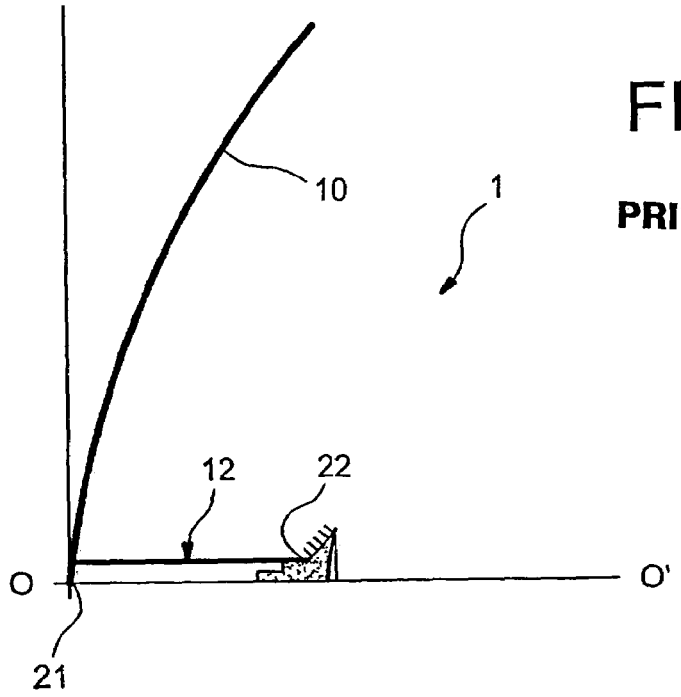
FIG. 1 PRIOR ART
FIG. 1, already described, represents a diagrammatic half-section in a plane passing through an axis of symmetry of an antenna comprising a main reflector and a feed; this figure is intended to show the relative positions of the main reflector and the feed, and applies equally to the prior art and to the present invention.

One nonlimiting embodiment of the invention is described next with reference to FIGS. 1 and 3. Referring to FIG. 1, like the prior art feed, the feed 12 according to the invention is intended for an antenna 1 having symmetry of revolution about an axis OO' of the antenna 1. As in the example of the prior art, an antenna 1 provided with a feed 12 according to the invention comprises a main reflector 10 having a concavity whose shape is that of a paraboloid rotated about the axis OO', for example, so as to be markedly directional in the direction of the axis OO'. The feed device 12 of the antenna 1 is situated along the axis OO' the antenna 1 in the portion of the reflector having the concavity. Like the whole of the antenna, it has symmetry of revolution above the axis OO'.

Figure 3:
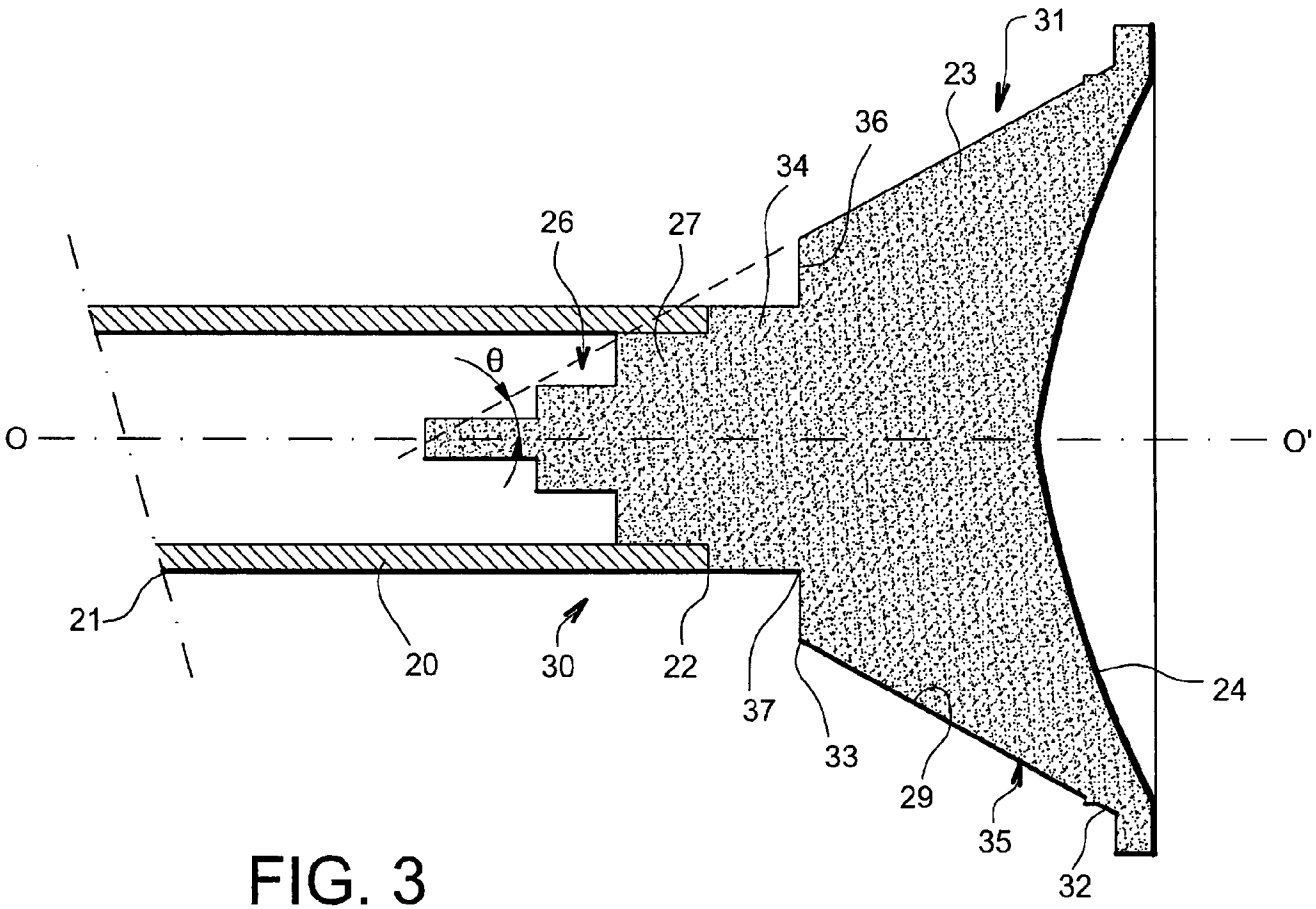
FIG. 3 shows a diagrammatic section of an antenna feed according to the present invention in a plane passing through the axis of symmetry of the antenna.

The embodiment of the feed device 12 according to the invention is shown in more detail in FIG. 3. It comprises a waveguide portion 20 extending along the axis OO', in a direction from the center of the reflector 10 and inside the concavity. A first end 21 of this waveguide 20 consists of the place where the waveguide 20 passes the main reflector 10. This first end is situated at the center of the main reflector 10. A second end 22 of the waveguide 20 faces a subreflector 24. As in the prior art, the subreflector 24 intersects the axis OO'. It has a shape obtained by rotation about the axis OO'. It has a convexity that faces the concavity of the main reflector 10. The outside diameter of the subreflector 24 is greater than the diameter of the waveguide 20. To confine electromagnetic waves between the second end 22 of the waveguide 20 and the subreflector 24, a portion of the feed 12 consists of a dielectric body 23 joining the second end 22 of the waveguide 20 and the subreflector 24.

The invention differs from the prior art essentially in the shape of an exterior portion 31 of the dielectric body 23. It will also be shown that the shape in accordance with the invention of the dielectric body 23 enables the dimensions of the subreflector 24 to be reduced for the same efficiency.

The dielectric body 23 is formed of two adjacent portions, namely a portion 30 inside the waveguide 20 and a portion 31 outside the waveguide 20. This external portion 31 has a section 35 of frustoconical shape having an outside lateral surface 29 of frustoconical shape with two ends 32, 33, namely a large diameter end 32 and a small diameter end 33. The outside lateral surface 29 of the frustoconical section 35 is smooth, i.e. it has none of the grooves or creases of the prior art.

The small diameter end 33 of the lateral outside surface 29 of the frustoconical section 35 is connected to a cylindrical portion 34 of the dielectric body 23 that is also outside the waveguide 20. Like the remainder of the dielectric body 23 this cylindrical portion 34 has a shape obtained by rotation about the axis OO'. The cylindrical portion 34 has a first end 22 that coincides with the second end 22 of the waveguide 20 and a second end 37 at which this cylindrical portion 34 connects to the frustoconical shape 35 at its small diameter end 33. The small diameter of the frustoconical portion 35 is greater than the diameter of the cylindrical portion 34. The diameter of the cylindrical portion 34 is preferably from 1.1 to 1.3 times the inside diameter $d_{pipe}$ of the waveguide 20. The large diameter of the frustoconical shape 35 is substantially equal to the outside diameter of the subreflector 24.

The portion 30 of the dielectric body 23 inside the waveguide 20 has at the end 22 a portion 27 whose diameter is equal to the inside diameter of the waveguide 20. This portion 27 is extended in the direction of the first end 21 by a second portion 26 whose diameter decreases at a step or at several successive steps. This structural feature improves the electromagnetic coupling between the waveguide 20 and the dielectric body 23. This in particular reduces the reflection loss rate.

In this embodiment the cylindrical outside portion 34 takes the form of an additional step in diameter that extends outwards the successive steps in diameter steps of the interior portion 30.

In the embodiment shown in FIG. 3, the small diameter of the frustoconical portion 35 is greater than the diameter of the cylindrical portion 34 outside the dielectric body 23. There is therefore an additional exterior step.

In this embodiment, a junction surface 36 of the dielectric body 23 between the outside cylindrical portion 34 and the small diameter end 33 of the frustoconical portion 35 consists of a plane circular ring 36 perpendicular to the axis OO' and delimited by two concentric circles centered on the axis OO', one having a diameter equal to the diameter of the cylindrical portion 34 external, the diameter of the other being equal to the small diameter of the frustoconical lateral surface 29. This is not mandatory, and in particular the junction surface between the second end 37 of the cylindrical portion 34 and the frustoconical portion 35 could consist of a frustoconical surface joining the end 37 of the cylindrical portion 34 and the end 33 of the frustoconical surface 29, for example. In this case the apex of the frustoconical junction surface would be closer to the subreflector 24 than the end 37.

The axial length of the cylindrical outside portion 34 of the dielectric body 23 is preferably from $\lambda/4$ to $\lambda/2$, $\lambda$ designating the wavelength in free space of the electromagnetic wave having a median frequency of a frequency band to which the antenna 1 is tuned. If the waveguide is a guide that passes the wave in fundamental mode, the inside diameter of the waveguide is approximately $0.65\,\lambda$. Thus the axial length of the cylindrical external portion 34 of the dielectric body 23 is generally from d/1.3 to d/2.6, d designating the inside diameter of the waveguide.

In the embodiment shown, the value of the dielectric constant $\epsilon_r$ of the material constituting the dielectric body 23 is close to 2.5. The value of the angle $\theta$ at the apex of the frustoconical surface 29 of the dielectric body is close to 30°.

Figure 2:
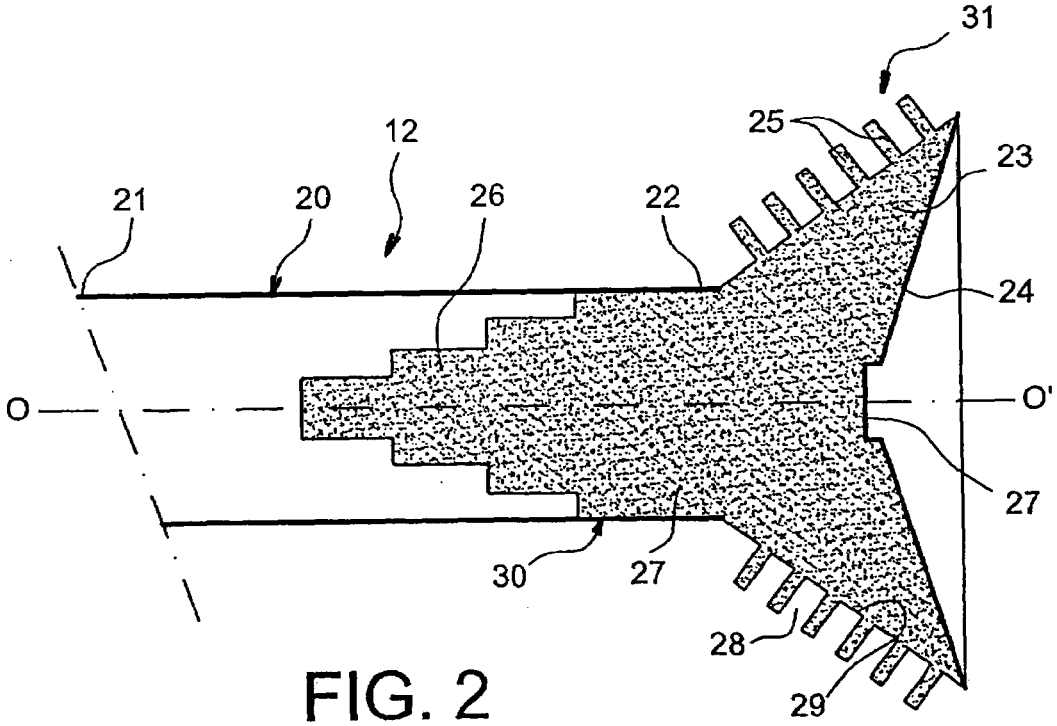
FIG. 2 PRIOR ART
FIG. 2, already described, shows a diagrammatic section in a plane passing through the axis of symmetry of the antenna of a prior art antenna feed.

As in the prior art, the subreflector 24 is deposited onto one face of the dielectric body 23 intersecting the axis OO'. It has a polynomial shape. This means that the profile of the metallized surface of the subreflector follows a polynomial curve, generally of the third order at most, in accordance with the formula $a+bX+cX^2+dX^3$, where a, b, c and d may be equal to zero. Comparisons between 0.65 meter diameter parabolic directional antennas comprising a feed of the type described with reference to FIG. 2 and 0.65 meter diameter parabolic directional antennas conforming to the embodiment described with reference to FIG. 3 follow.

Figure 4A:
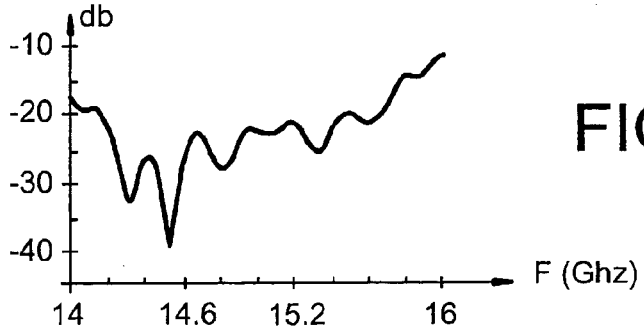
FIGS. 4A and 4B each show a curve representing, as a function of the value of the frequency, plotted on the abscissa axis, the value of the reflection loss rate for an antenna tuned to 15 gigahertz, namely a prior art antenna in FIG. 4A and an antenna according to the present invention in FIG. 4B.
Figure 4B:
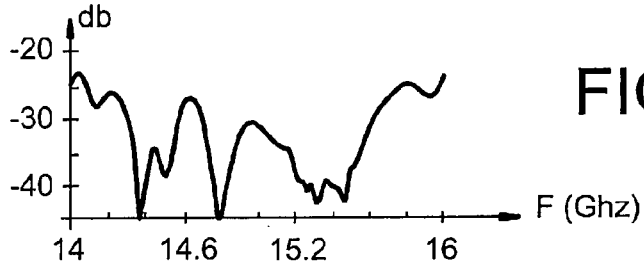

FIGS. 4A and 4B each show a curve representing as a function of the frequency, plotted on the abscissa axis, the reflection loss rate for an antenna tuned to 15 gigahertz, namely for a prior art antenna in FIG. 4A and for an antenna according to the present invention in FIG. 4B.

The reflection loss rate is measured for frequencies from 14 to 16 gigahertz.

Figure 5A:
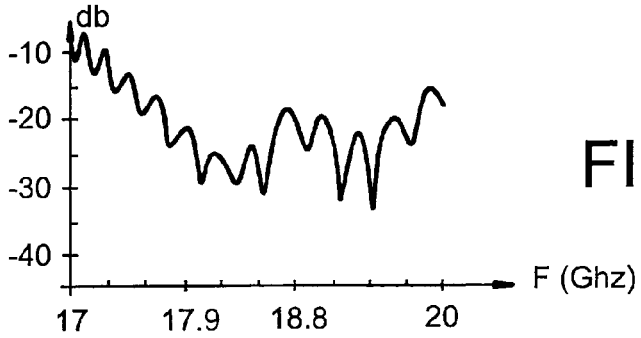
FIGS. 5A and 5B each show a curve representing, as a function of the value of the frequency, plotted on the abscissa axis, the value of the reflection loss rate for an antenna tuned to 19 gigahertz, namely a prior art antenna in FIG. 5A and an antenna according to the present invention in FIG. 5B.
Figure 5B:
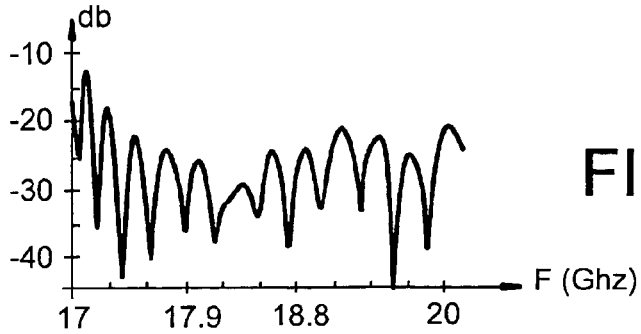

FIGS. 5A and 5B each show a curve representing as a function of the frequency, plotted on the abscissa axis, the reflection loss rate for an antenna tuned to 19 gigahertz, namely for a prior art antenna in FIG. 5A and for an antenna according to the present invention in FIG. 5B.

The reflection loss rate is measured for frequencies from 17 to 20 gigahertz.

Note in both cases that the frequency band of the antenna comprising the feed according to the invention is increased from a 1.15 GHz band extending from 14.2 to 15.35 GHz to a 2 GHz band extending from 14 to 16 GHz, for antennas tuned to 15 gigahertz, and from a 2 GHz band extending from 17.7 to 19.7 GHz to a 3 GHz band extending from 17 to 20 GHz for antennas tuned to 19 gigahertz.

It has been estimated in both cases that the reflection rate does not compromise the bandwidth provided that it is below −20 decibels.

Figure 6A:
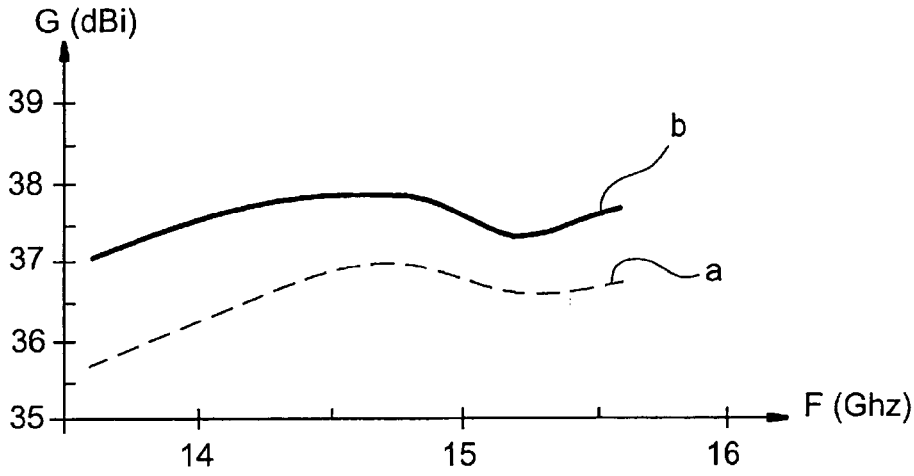
FIG. 6A shows, for an antenna tuned to 15 gigahertz, two curves each representing, as a function of the value of the frequency, plotted on the abscissa axis, the value of the directional gain, plotted on the ordinate axis, one of the two curves being that for a prior art feed and the other that for a feed according to the present invention.

FIG. 6A represents, for an antenna tuned to 15 gigahertz, two curves a and b each representing the directional gain, plotted on the ordinate axis, as a function of the frequency, plotted on the abscissa axis, the dashed line curve a being for a prior art feed and the curve b for a feed according to the present invention.

It is seen that the average improvement in differential directionality for frequencies from approximately 13.5 to 15.5 gigahertz is approximately 1.4 decibels in favor of the antenna having the feed according to the invention.

Figure 6B:
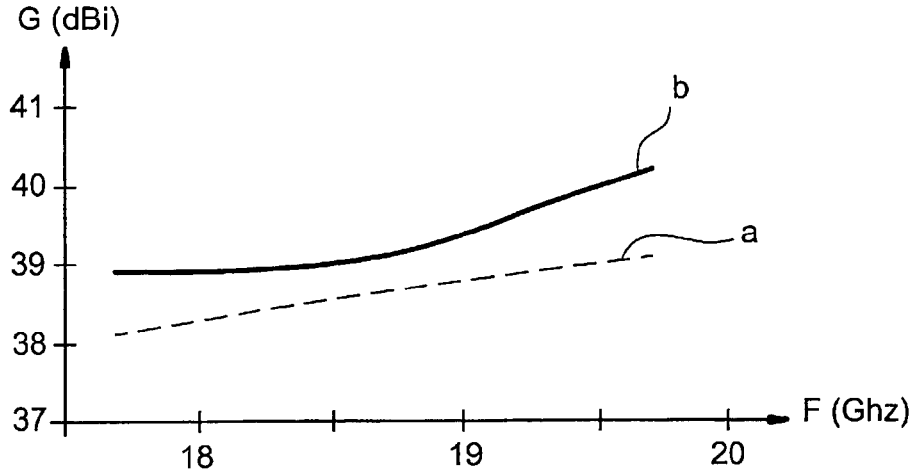
FIG. 6B shows, for an antenna tuned to 19 gigahertz, two curves each representing, as a function of the value of the frequency, plotted on the abscissa axis, the value of the directional gain, plotted on the ordinate axis, one of the two curves being that for a prior art feed and the other that for a feed according to the present invention.

FIG. 6B represents, for an antenna tuned to 19 gigahertz, two curves a and b each representing the directional gain, plotted on the ordinate axis, as a function of the frequency, plotted on the abscissa axis, the dashed line curve a being for a prior art feed and the curve b for a feed according to the present invention.

It is seen that the average improvement in differential directionality for frequencies from approximately 17.7 to 19.7 gigahertz is approximately 1 decibel in favor of the antenna having the feed according to the invention.

This is reflected in the fact that, for each of the two antennas, the energy contained in the main lobe is of the order of 66% of the total energy, whereas for a prior art antenna this proportion is hardly 50%.

The invention claimed is:

1. An antenna feed comprising, aligned and centered on an axis OO':

a waveguide having an inside diameter, a first end, and a second end, a dielectric body having a portion inside said waveguide and a portion outside said waveguide, said outside portion comprising a section of frustoconical shape having an outside lateral surface of frustoconical shape with two ends, namely a large diameter end and a small diameter end, a subreflector at the large diameter end of said frustoconical shape, and wherein said outside portion comprises, in addition to said frustoconical portion, a cylindrical portion whose diameter is greater than the inside diameter of said waveguide, said cylindrical portion being connected to said frustoconical portion at its small diameter end, and said frustoconical outside lateral surface of said dielectric body is smooth.

2. The antenna feed claimed in claim 1 wherein said small diameter of said frustoconical portion is greater than the diameter of said cylindrical outside portion of said dielectric body.

3. The antenna feed claimed in claim 2 wherein a junction surface of said dielectric body between said outside cylindrical portion and said small diameter end of said frustoconical portion of said dielectric body consists of a plane circular ring perpendicular to said axis OO', delimited by two concentric circles centered on said axis OO', one having a diameter equal to the diameter of said outside cylindrical portion, the diameter of the other being equal to said small diameter of said frustoconical lateral surface.

4. The antenna feed claimed in claim 1 wherein the axial length of said cylindrical outside portion of said dielectric body is from $\lambda/4$ to $\lambda/2$, $\lambda$ designating the wavelength in free space of an electromagnetic wave having a median frequency of a frequency band to which said antenna is tuned.

5. The antenna feed claimed in claim 1 wherein the value of the dielectric constant $\epsilon_r$ of the material constituting said dielectric body is close to 2.5 and the value of the angle $\theta$ at the apex of the surface of said dielectric body is close to 30°.

6. The antenna feed claimed in claim 1 wherein the diameter of said cylindrical outside portion is from 1.1 to 1.3 times the inside diameter of said waveguide.

7. A directional antenna equipped with a reflector and with a feed according to claim 1.

* * * * *